United States Patent [19]

Allaire et al.

[11] 4,345,528

[45] Aug. 24, 1982

[54] WOOD BURNING STOVE

[75] Inventors: Roger A. Allaire, Big Flats; Robert V. VanDewoestine, Corning, both of N.Y.

[73] Assignee: Corning Glass Works, Corning, N.Y.

[21] Appl. No.: 173,156

[22] Filed: Jul. 28, 1980

[51] Int. Cl.[3] ..... F23J 15/00

[52] U.S. Cl. ..... 110/203; 110/345; 422/177

[58] Field of Search ..... 110/203, 345, 210; 422/177; 126/299 F

[56] References Cited

U.S. PATENT DOCUMENTS 2,845,882 8/1958 Bratton ..... 110/203 X 2,933,080 4/1960 Adey ..... 126/299 F X 4,054,418 10/1977 Miller et al. ..... 110/203 X 4,089,088 5/1978 Konczalski ..... 422/177

*Primary Examiner*—Edward G. Favors

*Attorney, Agent, or Firm*—Richard N. Wardell

[57] ABSTRACT

Disclosed herein is an improved wood burning stove employing a combustion chamber and a flue in communication therewith for removal of exhaust from the chamber with a catalytic converter means being movably mounted in the flue whereby the impedance presented to the exhaust by the converter may be selectively varied so as to minimize the impedance presented by the converter means when additional fuel is added to the stove.

6 Claims, 7 Drawing Figures

WOOD BURNING STOVE

BACKGROUND OF THE INVENTION

This invention relates in general to an improvement in wood burning stoves and in particular it relates to a method and apparatus for increasing the efficiency and safety of wood burning stoves.

Due to the relative scarcity and high cost of petroleum products, wood burning stoves have been increasingly employed for home heating and other purposes. A reasonably air tight wood burning stove is far more efficient than a home fireplace, which may result, in fact, in a net energy loss. However, wood burning stoves presently being utilized suffer from three significant drawbacks. First, wood burning stoves represent a severe fire hazard since the wood fuel therefore contains volatible substances which are normally not oxidized during combustion. These volatiles will burn if mixed with air at temperatures in excess of 590° C. However, the typical wood burning stove operates within a temperature range of between 230° and 370° C. At these temperatures, these volatible substances, known generally as creosote, remain unoxidized and tend to adhere to the flue pipes and are a cause of not infrequent chimney fires. Secondly, the incomplete combustion of the carbonaceous fuel in wood burning stoves leaves the unoxidized residue as a pollutant and an environmental hazard which is discharged to the atmosphere. Third, the unoxidized residue represents a loss of overall combustion efficiency. While claims have been made to efficiencies greater than 65% in some wood burning stoves, independent testing laboratories have determined that the combustion efficiency of typical wood burning stoves lies in the range of between 50 and 65%. One possible solution to the aforementioned problems is to increase the combustion temperature of the typical wood burning stove by providing additional air into the combustion chamber so as to create temperatures high enough to bring about complete combustion. Variations on this technique date back to the 18th century with the Franklin stove, wherein the volatiles are mixed with additional air in the combustion chamber in order that temperatures high enough to bring about complete combustion may be obtained. These efforts have only been partially successful.

In application Ser. No. 173,155 filed July 28, 1980. by Van Dewoestine , which is assigned to the assignee of the present invention, an improved wood burning stove is disclosed which obviates the foregoing problems. The wood burning stove disclosed therein employs a catalytic converter means which oxidizes oxidizable species in the exhaust from a standard wood burning stove. A wood burning stove modified to include a catalytic converter means provides increased safety due to the removal of creosote from the exhaust therefrom. Secondly, the wood burning stove disclosed by Van Dewoestine reduces unoxidized carbonaceous pollutants emitted from the stove. Thirdly, the improved wood burning stove disclosed by Van Dewoestine provides improved fuel efficiency through the use of the catalytic converter means.

However, it has been found that during startup and also once combustion is started and during the addition of fuel to the wood burning stove disclosed by Van Dewoestine, the impedance to the exhaust emanating from the stove caused by the catalytic converter means is detrimental. Specifically, it has been found that when the stove is opened, such as, for example, when adding additional fuel, back pressure caused by the catalytic converter becomes excessive such that smoke and soot may emanate from the opening to the stove and may be expelled into the room being heated.

OBJECTS OF THE INVENTION

It is an object of the present invention to provide an improved wood burning stove employing a catalytic converter means which eliminates excessive back pressure during the loading of additional fuel to the stove.

It is a further object of the present invention to provide an improved wood burning stove employing a catalytic converter means which minimizes back pressure during the startup of combustion in the stove.

SUMMARY OF THE INVENTION

These and other objects of the present invention are achieved by the provision of a wood burning stove having a combustion chamber and a flue emanating therefrom with a catalytic converter means situated in the flue. The catalytic converter is provided for removing oxidizable species in the exhaust, the catalytic converter means being movably mounted with respect to the flue such that the impedance to the exhaust caused by the converter may be selectively varied.

In accordance with the preferred embodiment of the present invention, the catalytic converter means is a honeycomb structure having a plurality of catalytically active passageways extending therethrough and the catalytic converter is rotatably mounted within the flue such that the impedance may be minimized by rotating the longitudinal axes of the passageways so as to be perpendicular to the longitudinal axis of the flue during loading and start up thereby permitting exhaust to bypass the converter means.

In still another embodiment of the present invention, the catalytic converter means is slidably mounted in the flue such that the number of passageways exposed to the exhaust in the flue may be selectively varied.

RELATED APPLICATIONS

The copending application Ser. No. 173,157 filed July 28, 1980 of Allaire et al., discloses another mounting arrangement for a catalytic converter means in a wood burning stove which minimizes back pressure during loading and start up.

DESCRIPTION OF THE PREFERRED EMBODIMENT

Figure 1:
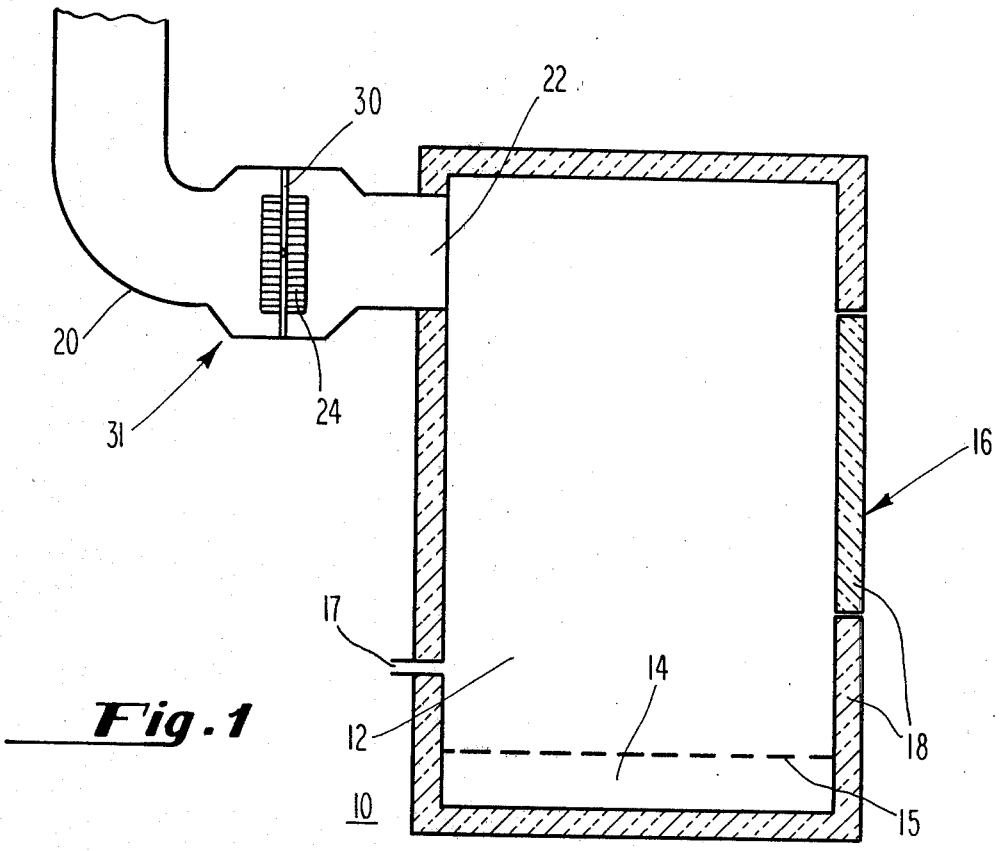
FIG. 1 is a cross-sectional view of a wood burning stove employing the catalytic converter means mounted in accordance with one embodiment of the present invention.

Referring now to FIG. 1, a cross-sectional view of a typical wood burning stove modified in accordance with one embodiment of the present invention will be described. A wood burning stove is shown generally at 10. The wood burning stove 10 includes a firebox or primary combustion chamber 12 situated above an ash pan 14. Communication between the combustion chamber 12 and the ash pan 14 is accomplished by means of a grate 15. Access to the primary combustion chamber 12 is by means of an entrance door or hatch shown generally at 16. Suitable insulation 18 may surround the combustion chamber 12 including the interior surface of the hatch or door 16, although such insulation is not a requirement. A flue 20 communicates with the combustion chamber 12 by means of an exit port 22. A primary air inlet port 17 provides a source of oxygen for combustion within the primary combustion chamber 12. Wood fuel is combusted in the primary combustion chamber 12 and exhaust gases emanating therefrom pass through exit port 22 to the flue 20 and from there to the outside environment.

In accordance with the invention described in the aforementioned application of Van Dewoestine, a catalytic converter means 24 is situated internal to the flue 20 immediately adjacent to the exit port 22 from the combustion chamber 12. In accordance with the Van Dewoestine invention, the catalytic converter means 24 is situated as close as possible to the combination chamber 12, even extending, in part, into the combustion chamber 12 if the configuration of the exit port 22 permits such an installation. The catalytic converter means 24 is preferably a honeycomb structure having a plurality of catalytically active passageways extending therethrough. The aforementioned insulation 18 is provided to ensure that at least some of the heat liberated in the combustion chamber 12 is utilized to cause light off of the converter means 24.

In accordance with the present invention, the catalytic converter means 24 is movably mounted with respect to the flue 20 such that the impedance presented by the catalytic converter means 24 with respect to the exhaust passing through the flue 20 may be selectively varied.

Figure 2:
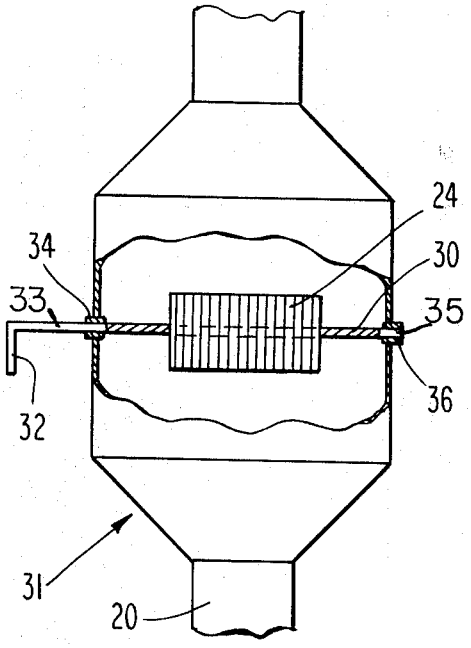
FIG. 2 is a detailed view of the mounting arrangement of the catalytic converter means shown in FIG. 1 in a first position.
Figure 3:
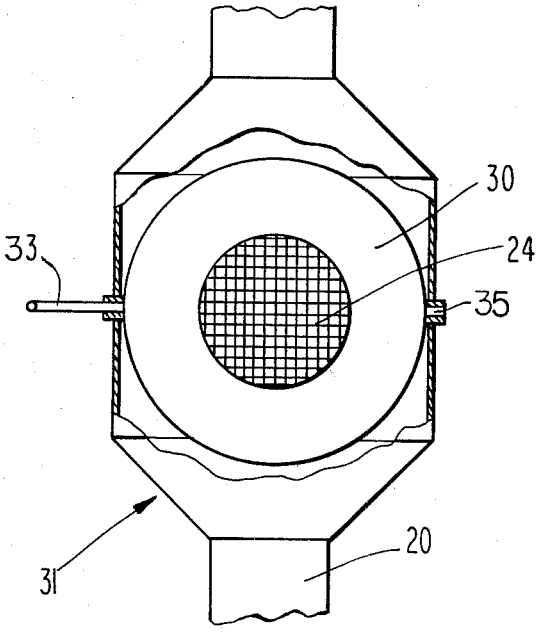
FIG. 3 is a detailed view of the mounting arrangement of the catalytic converter means shown in FIG. 2 in a second position.

As may be seen in FIGS. 1–3, in the vicinity 31 of the catalytic converter means 24, the flue 20 may have a greater cross-sectional area than upstream and downstream of the catalytic converter means 24.

In accordance with the preferred embodiment of the present invention and as will be more fully understood by reference to FIGS. 2 and 3, the catalytic converter means 24 is rotatably mounted in the flue 20 whereby the impedance presented by the catalytic converter means may be selectively varied depending upon the rotational position of the catalytic converter. Preferably, the catalytic converter means 24 is situated within the central aperture of an annular mounting bracket or plate 30. An axle or axial means 35 projecting from the circumferential edge of the mounting bracket or plate 30 mates with a bushing 36 while axial means or pivot 33 mates with a bushing 34 such that rotation of the handle 32 varies the angular position of the plate 30 and the catalytic converter means 24 with respect to the longitudinal axis of the flue 20. It will, of course, be appreciated, that when the longitudinal axes of the catalytically active passageways of the catalytic converter means 24 are parallel to the longitudinal axis of the flue 20 as shown in FIG. 2, the impedance presented by the catalytic converter means 24 is maximized. However, when the catalytic converter means 24 is rotated such as is shown in FIG. 3 and the longitudinal axes of the passageways of the converter 24 are perpendicular to the axis of the flue 20, the impedance presented by the catalytic converter means 24 is minimized because exhaust in the flue 20 bypasses the passageways.

In practice, the catalytic converter means 24 is placed in the position shown in FIG. 3 whenever the door or hatch 16 to the wood burning stove 10 is opened for the addition of new wood fuel for combustion in the primary combustion chamber 12.

As will be apparent to those skilled in the art, the provision of a flue having an enlarged cross-sectional area in the vicinity 31 of the catalytic converter 24 allows for the accommodation of converters of different thicknesses or passageway lengths. Without such an arrangement, the converter means 24 would not have sufficient clearance for rotation within the flue 20 unless its cross-sectional area were less than that predominating in the flue 20.

Since the catalytic converter means 24 may operate at temperatures of between 700° to 900° C. and since internal temperatures of the converter means 24 may at times reach 1100° C., it is desirable that the flue 20 have insulation (now shown) surrounding the same in the vicinity of the catalytic converter means 24.

Figure 5:
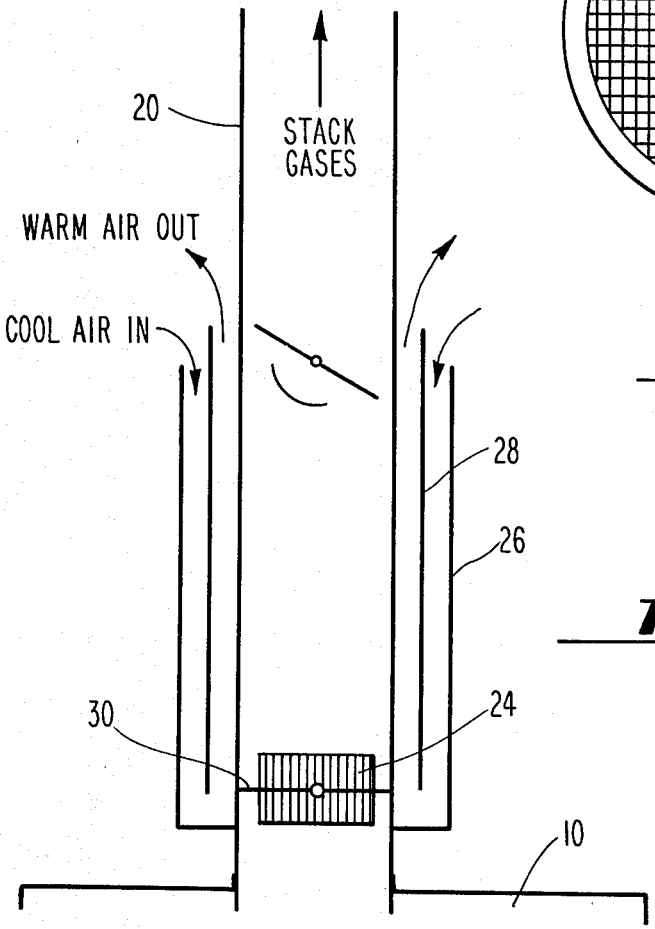
FIG. 5 is a detailed view of an alternative embodiment of the mounting arrangement shown in FIGS. 2–3.

Alternatively, as shown in FIG. 5, it is desirable to provide the flue 20 with a shielding means comprising a first generally cylindrically shaped baffle 26 surrounding an internal cylindrical baffle 28. Cool air enters the space between the first baffle 26 and the second baffle 28 and passes in the vicinity of the catalytic converter means 24 and then exits in the space between the second baffle 28 and the flue 20. Such an installation not only shields the high temperatures of the catalytic converters means 24 from persons in the vicinity thereof, but also provides an additional source of heat transfer to the space being heated by the wood burning stove 10, thus increasing the combustion efficiency of the stove.

Figure 4A:
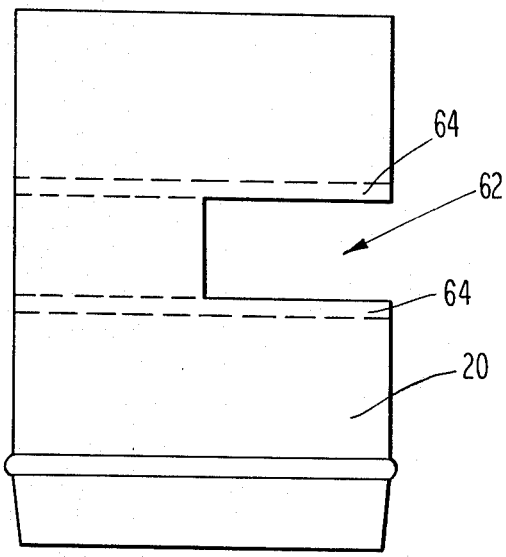
FIG. 4A is an elevational view of a flue for a wood burning stove having an alternative mounting arrangement for a catalytic converter means from that shown in FIGS. 1-3.
Figure 4B:
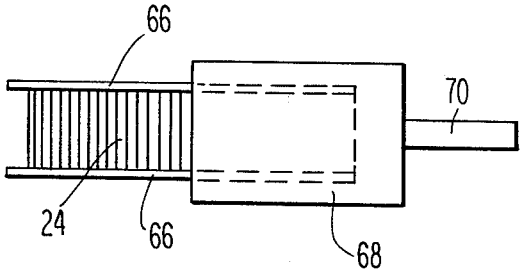
FIG. 4B is an elevational view of a catalytic converter means and mounting bracket therefor for use with the flue of FIG. 4A.
Figure 4C:
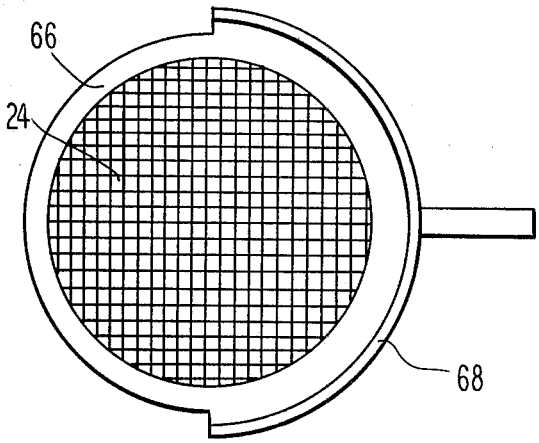
FIG. 4C is a top view of the catalytic converter means and mounting bracket shown in FIG. 4B.

Referring now to FIGS. 4A–4C, another mounting arrangement from that shown in FIGS. 1–3 will be described. In the embodiment shown in FIGS. 4A–4C, a mounting arrangement wherein a catalytic converter means is slidably mounted within a flue will be described. As shown in FIG. 4A, a portion of the flue 20 may have an opening 62 formed therein. The opening 62 extends at least 180° about the periphery of the flue 20. Parallel tracks 64 are provided extending about the internal circumference of the flue 20. As shown in FIG. 4B, the catalytic converter means 24 is provided with annular mounting brackets 66 abutting the converter means 24 which act as guide means mating which the parallel tracks 64 for slidable engagement therewith. The brackets or guide means 66 are joined to a shielding means 68 having a suitable handle 70, such that the catalytic converter means 24 may be selectively placed within the flue 20. The shield 68 provides a closure to the opening 62 when the catalytic converter means 24 is within the flue 20. The converter means 24 thus may be at least partially removed from the flue 20 when new or additional fuel is added to the combustion chamber 12, thus eliminating excess back pressure during such occurrences. An additional shielding means similar to that shown at 68 may also be provided which is not associated with a catalytic converter means for closing opening 62 when new or additional fuel is added to the combustion chamber so that smoke does not exit from this opening.

While particular embodiments of the present invention have been shown and described, other modifications of the invention not specifically mentioned above which will occur to those skilled in the art are intended to be included within the scope of the appended claims.

What is claimed is:

1. A wood burning stove comprising:

a combustion chamber with an access door;

a flue in communication with said combustion chamber for removing exhaust therefrom;

a catalytic converter means for removing oxidizable species from said exhaust, said catalytic converter means having a honeycomb structure having a plurality of catalytically active passageways extending therethrough and being rotatably mounted in and transversely across said flue whereby impedance to said exhaust caused by said converter means may be selectively maximized when the longitudinal axes of said passageways are parallel to the longitudinal axis of the flue and minimized when the longitudinal axes of said passageways are perpendicular to the longitudinal axis of said flue; and means for moving said converter means between positions of said converter means substantially extending transversely across said flue and of said converter means insubstantially extending across said flue, said means for moving said converter means comprising axial means extending transverse of said flue and on which said converter means is mounted for rotation between positions of said converter means substantially extending transversely across said flue with said passageways parallel to the longitudinal axis of the flue and of said converter means insubstantially extending transversely across said flue with said passageways perpendicular to the longitudinal axis of said flue.

2. The wood burning stove of claim 1 further comprising:

a mounting bracket situated about the circumference of said converter means, the shape of the perimeter of said mounting bracket corresponding to the cross-sectional shape of said flue in the vicinity of said converter means, and said axial means extending from opposite edges of said mounting bracket.

3. The stove of claim 2 wherein said flue has a lesser cross-sectional area upstream and downstream of said vicinity than at said vicinity.

4. The stove of claim 2 wherein said mounting bracket is annular.

5. A wood burning stove comprising:

a combustion chamber with an access door;

a flue in communication with said combustion chamber for removing exhaust therefrom;

a catalytic converter means for removing oxidizable species from said exhaust, said catalytic converter means being a honeycomb structure having a plurality of catalytically active passageways extending therethrough and being slidably mounted in and transversely across said flue with the passageways parallel to the longitudinal axis of said flue whereby the number of said passageways exposed to said exhaust may be varied so that impedance to said exhaust caused by said converter means may be selectively varied; and means for moving said converter means between positions of said converter means substantially extending transversely across said flue and of said converter means insubstantially extending across said flue, said means for moving said converter means comprising sliding means for slidably moving said converter means transversely of said flue.

6. The stove of claim 5 wherein said sliding means includes a track means on said flue and guide means for mating with said track means on said converter means.

* * * * *

REEXAMINATION CERTIFICATE (325th)

United States Patent [19] [11] B1 4,345,528

Allaire et al. [45] Certificate Issued Mar. 26, 1985

[54] WOOD BURNING STOVE

[75] Inventors: Roger A. Allaire, Big Flats; Robert V. VanDewoestine, Corning, both of N.Y.

[73] Assignee: Corning Glass Works, Corning, N.Y.

Reexamination Request:
No. 90/000,512, Feb. 27, 1984

Reexamination Certificate for:

| | |
|---|---|
| Patent No.: | **4,345,528** |
| Issued: | **Aug. 24, 1982** |
| Appl. No.: | **173,156** |
| Filed: | **Jul. 28, 1980** |

[51] Int. Cl.[3] ..... F23J 15/00

[52] U.S. Cl. ..... 110/203; 55/307; 110/345; 126/285 R; 422/177

[58] Field of Search ..... 110/203, 345, 210, 211, 110/216, 119; 422/177; 126/299 F, 285 R, 285 A, 292, 297; 55/307

[56] References Cited

U.S. PATENT DOCUMENTS

| | | | |
|---|---|---|---|
| 3,043,245 | 7/1962 | Hebert et al. . | |
| 4,089,088 | 5/1978 | Konczalski | 422/177 |
| 4,279,629 | 7/1981 | Simms . | |

*Primary Examiner*—Edward G. Favors

[57] ABSTRACT

Disclosed herein in an improved wood burning stove employing a combustion chamber and a flue in communication therewith for removal of exhaust from the chamber with a catalytic converter means being movably mounted in the flue whereby the impedance presented to the exhaust by the converter may be selectively varied so as to minimize the impedance presented by the converter means when additional fuel is added to the stove.

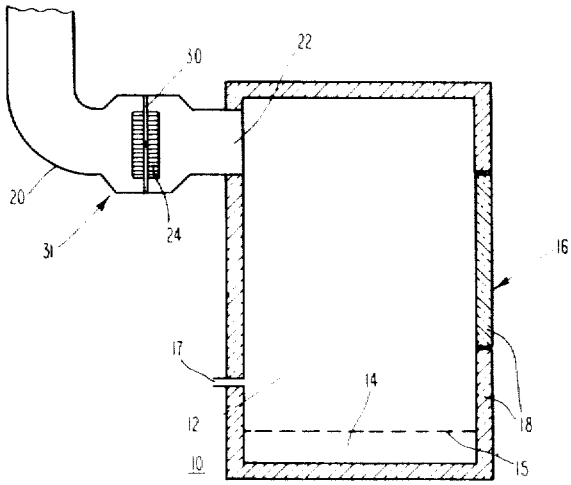

REEXAMINATION CERTIFICATE ISSUED UNDER 35 U.S.C. 307de

NO AMENDMENTS HAVE BEEN MADE TO THE PATENT.

AS A RESULT OF REEXAMINATION, IT HAS BEEN DETERMINED THAT:

The patentability of claims 1-6 is confirmed.

* * * * *